US006089386A

United States Patent [19]

Shiau et al.

[11] Patent Number: 6,089,386

[45] Date of Patent: Jul. 18, 2000

[54] ARTICLE DISPLAY SUPPORT

[76] Inventors: Hong-Rong Shiau; Fu-Zue Lin, both of 4662 Rolling Ridge, West Bloomfield, Mich. 48323-3341

[21] Appl. No.: 09/351,236

[22] Filed: Jul. 12, 1999

[51] Int. Cl.[7] ..... A47F 5/00

[52] U.S. Cl. ..... 211/85.15; 211/89.01; 211/119

[58] Field of Search ..... 211/119, 89.01, 211/85.15, 71.01

[56] References Cited

U.S. PATENT DOCUMENTS

| | | | |
|---|---|---|---|
| 2,400,058 | 5/1946 | Concannon | 211/89.01 X |
| 2,532,022 | 11/1950 | Gunderson | 211/87 |
| 2,547,531 | 4/1951 | Melvin et al. | 24/81 |
| 2,562,777 | 7/1951 | Dreyfus | 211/89.01 |
| 2,630,923 | 3/1953 | Makar | 211/85.15 |
| 2,677,468 | 5/1954 | Dreyfus | 211/85.15 |
| 3,498,469 | 3/1970 | Hummel | 211/71 |
| 3,967,346 | 7/1976 | Young, Jr. | 24/73 |
| 5,967,341 | 10/1999 | Werner | 211/85.15 |

*Primary Examiner*—Robert W. Gibson, Jr.
*Attorney, Agent, or Firm*—Charles W. Chandler

[57] ABSTRACT

An article display device comprising a metal vertically supported rod, and a plurality of spaced plastic clips thereon. Each plastic clip comprises a body having an integral J-shaped section integrally connected to the body. The J-shaped section has a slot passing through the bight of the J-shaped section for receiving the rod to a position in which one end of the clip is resiliently biased against the rod, and the other end of the body may be depressed toward the rod to form an opening between the jaw of the clip and the rod for receiving a displayed article.

3 Claims, 1 Drawing Sheet

ARTICLE DISPLAY SUPPORT

BACKGROUND OF THE INVENTION

This invention is related to an article display device for displaying individually packaged goods in a vertical array along a metal rod.

Display racks commonly employ a vertical support member with a series of vertically spaced clips for supporting individually packaged articles for display and sale to the public. Examples of such prior art may be found in U.S. Pat. No. 3,967,346 issued Jul. 6, 1976 to Bruce Young Jr. for "Display Rack Clip"; U.S. Pat. No. 2,547,531 issued Apr. 3, 1951 to Francis F. Melvin and Joe O. Stevens for "Spring Clip for Display Racks"; U.S. Pat. No. 2,532,022 issued Nov. 28, 1950 to Willard R. Gunderson for "Display Support"; and U.S. Pat. No. 3,498,469 issued Mar. 3, 1970 to Karl B. Hummel for "Display Rack Clamp".

Generally, such clips are mounted on a rod having a non-circular cross section so that the clips engage a flat surface so that they all face the same direction. If the clips are mounted on a rod having a round cross-section, then they tend to twist around the rod and not be properly aligned for display purposes.

SUMMARY OF THE INVENTION

The broad purpose of the present invention is to provide an improved article display device comprising a vertical metal rod having a generally circular cross-section with a series of spaced clip mounting locations. At each clip mounting location, the rod has opposed flat surfaces.

Each clip is formed of plastic and has a J-shaped mid section with a slot that receives the flat surfaces of the rod which not only help to support the clip but prevents it from rotating about the axis of the rod. The clip has an elongated body connected to the J-shaped section. One end of the body forms a jaw for engaging the display and article, the other end of the rod forms a depressible handle which is moved toward the rod to open the jaw for removing or inserting the merchandise.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
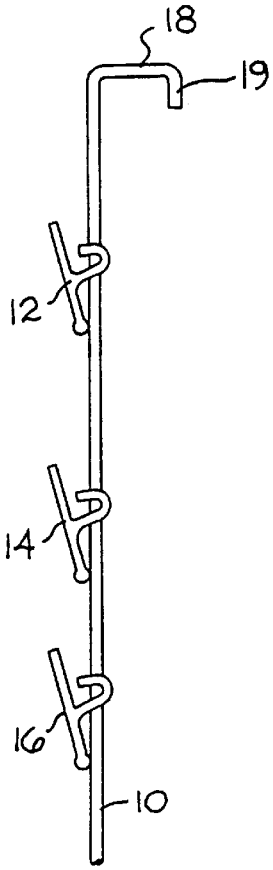
FIG. 1 is an elevational view illustrating a preferred rod, and a series of article display clips mounted on the rod.
Figure 2:
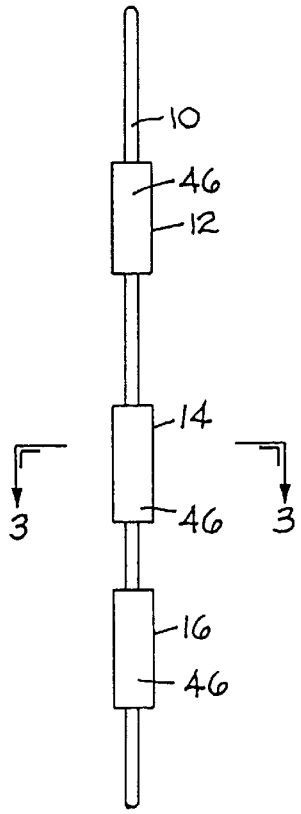
FIG. 2 is a fragmentary view generally as seen from the left side of FIG. 1.

Referring to the drawings, FIGS. 1 and 2 illustrate a preferred rod 10 supporting three plastic display clips 12, 14, and 16. The three clips are identical to one another and mounted in vertically spaced positions on the rod.

The rod is preferably made of metal and is about 1/16 inch in diameter and 27½ inches long. The rod may have any suitable length to accommodate the nature of the particular merchandise, not shown, being displayed. The upper end of the rod is bent to form a horizontal section 18 about 2⅛ inches long, and a downwardly depending tip 19 about 1½ inches long and which is parallel to the main body of the rod to form a generally hooked-shaped section suited for hanging over a conventional display board.

Figure 3:
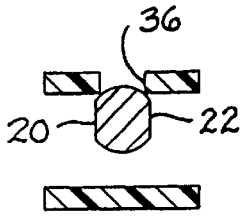
FIG. 3 is an enlarged view as seen along lines 3—3 of FIG. 2.
Figure 4:
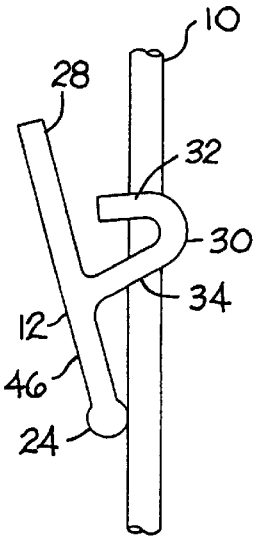
FIG. 4 is an enlarged view of a typical clip mounted on the rod.
Figure 6:
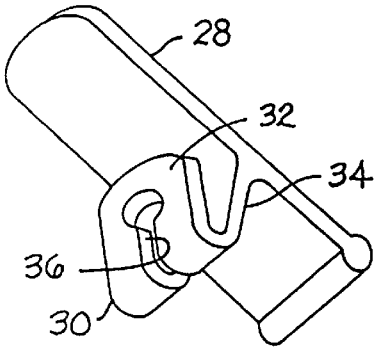
FIG. 6 is a perspective view of a typical clip.

Referring to FIGS. 1 and 3, show a plurality of clip mounting locations each defined by a pair of flat surfaces 20 and 22. The flat surfaces are parallel to one another and on opposite sides of the rod. For illustrative purposes, the flat surfaces are each about 9/16 inches long and spaced about 2½ inches apart. A typical clip 12 is formed of a suitable, somewhat resilient plastic. A typical clip as shown in FIGS. 4 and 6 has a body about 1 9/16 inches long, ½ inch wide and ⅛ inch thick. The body has a jaw end 24 which is somewhat enlarged and wider than the clip.

The opposite end of the body has a finger depressing end 28.

The clip has a J-shaped section 30 with two legs 32 and 34. The end of leg 34 is integrally attached to approximately the mid section of the body, that is, about ¾ inch from the finger depressing end.

Each clip has an elongated U-shaped slot 36, which is slightly narrower than the distance between each pair of flats 20 and 22 on the rod. The sides of the slot are resilient so that the rod can be inserted into the slot to a clamped position, illustrated in FIG. 3. The ends of the slot are enlarged to a somewhat circular configuration for seating the rod in legs 32 and 34.

Figure 5:
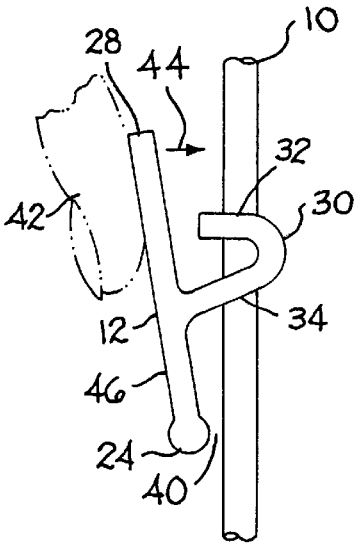
FIG. 5 is a view similar to FIG. 4 but showing the clip jaw in an open position.

The end of slot 36 in leg 34 is slightly longer than the end of slot 32 in the other leg so that when the clip is mounted on the rod, the J-shaped section supports the rod so that jaw 24 resiliently engages the rod as shown in FIG. 4. This is considered the closed position of the clip. To open the jaw to form an opening 40 as illustrated in FIG. 5, the user employs his finger or thumb 42 to apply a motion in the direction of arrow 44 toward the rod which moves the jaw end of the clip to form opening 40.

The clip can be easily and inexpensively manufactured, easily mounted on a rod such that a series of clips face in a common direction. Further, the flat surface 46 of the clip body forms an ideal location and area for advertising material.

What is claimed is:

1. An article display support, comprising:

an elongated rigid support rod having a generally circular cross-section, and at least one flat surface thereon;

a flexible plastic clip comprising an elongated body having a first finger-depressing end, and an opposite end forming a jaw;

the clip having J-shaped rod-gripping section including a pair of slightly spread legs comprising a first leg and a second leg connected to a bight, the second leg having an end integrally joined to the body in a location between said first end and said jaw, such that the body may be resiliently moved toward the end of the first leg;

the first and second legs having an elongated slot, the slot having a first end in the first leg and a second end in the second leg;

the first and second ends of the slot being aligned one with the other for receiving the rod in a position in which the jaw of the body resiliently engages the rod;

the slot having a mid section in the bight of the J-shaped section narrower than the enlarged ends to define an opening for receiving the rod into the enlarged ends of the slot to a position in which the body is disposed at an angle with respect to the rod;

the rod being disposed in the slot such that at least one flat surface on the rod so engages the slot as to resiliently align the body in a predetermined position on the rod wherein by depressing the finger-depressing end of the body toward the rod, the jaw end of the body is resiliently moved away from the rod for grasping an article to be displayed.

2. An article display support as defined in claim 1, in which the rod has a pair of opposed generally parallel flat surfaces thereon, and the rod is receivable in the slot such that the flat surfaces pass between the mid section of the slot to a position in the enlarged ends of the slot.

3. An article display support as defined in claim 1, in which the rod has a hook-shaped end for mounting on the edge of a supporting surface.

* * * * *